US005645046A

United States Patent [19]

Kay

[11] Patent Number: 5,645,046

[45] Date of Patent: Jul. 8, 1997

[54] BREATHING EQUIPMENT

[75] Inventor: Francis Xavier Kay, Bucks, United Kingdom

[73] Assignee: F. X. K. Patents Limited, United Kingdom

[21] Appl. No.: 508,487

[22] Filed: Jul. 28, 1995

[30] Foreign Application Priority Data

Aug. 3, 1994 [GB] United Kingdom ..... 9415722

[51] Int. Cl.[6] ..... A62B 9/06

[52] U.S. Cl. ..... 128/201.18; 128/207.14

[58] Field of Search ..... 128/201.18, 848, 128/858, 206.29, 206.21, 205.25, 206.12, 207.14

[56] References Cited

U.S. PATENT DOCUMENTS

| | | | |
|---|---|---|---|
| 2,428,425 | 10/1947 | Levitt | 128/201.18 |
| 3,658,058 | 4/1972 | Neidhart et al. | 128/201.18 |
| 4,090,511 | 5/1978 | Gray | 128/201.18 |
| 4,164,218 | 8/1979 | Martin | 128/201.18 |
| 4,294,243 | 10/1981 | Ernsting et al. | 128/201.18 |
| 4,440,165 | 4/1984 | Holzel | 128/201.18 |
| 4,449,526 | 5/1984 | Elam | 128/201.18 |
| 4,452,240 | 6/1984 | Moretti | 128/201.18 |

FOREIGN PATENT DOCUMENTS

| | | | |
|---|---|---|---|
| 51303 | 3/1890 | Germany | 128/201.18 |
| 669841 | 1/1939 | Germany | 128/201.18 |
| 4004157 | 4/1991 | Germany | 128/201.18 |

*Primary Examiner*—Edgar S. Burr
*Assistant Examiner*—Daniel J. Colilla
*Attorney, Agent, or Firm*—Kelly Bauersfeld; Lowry & Kelly, LLP

[57] ABSTRACT

A nostril blocker adapted for retained mounting upon the mouthpiece of breathing equipment and comprising a bifurcated resilient element that in use is disposed generally parallel with the mouthpiece gas passage and spaced therefrom by a distance such as to position limbs of the element to straddle the nasal septum and obturate the nostril openings of the user.

10 Claims, 5 Drawing Sheets

Fig.3A
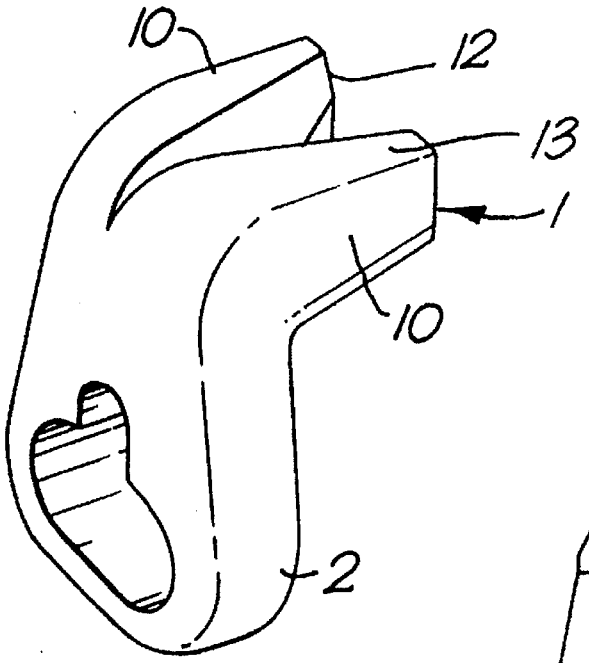
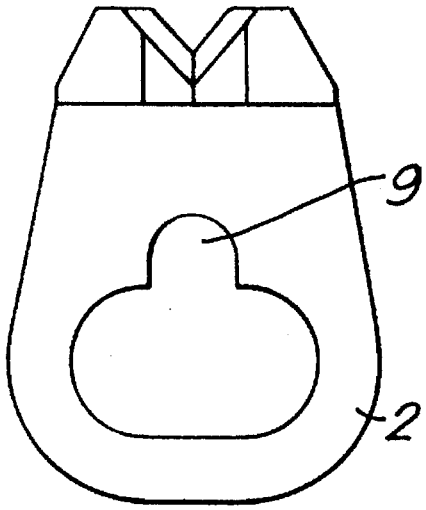
Fig.3B
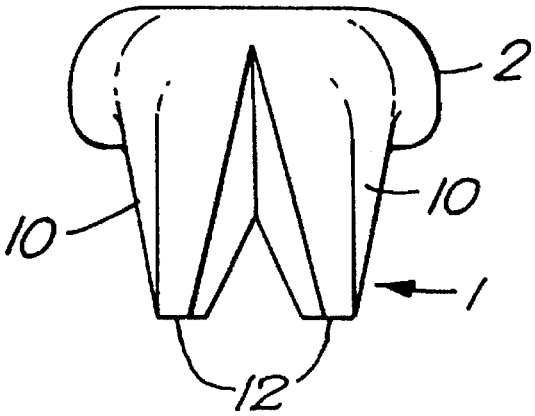
Fig.3C

Fig.5A
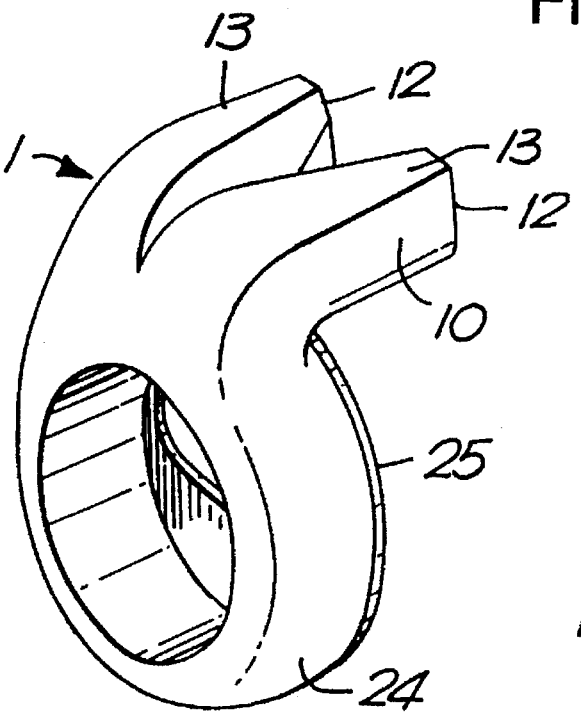
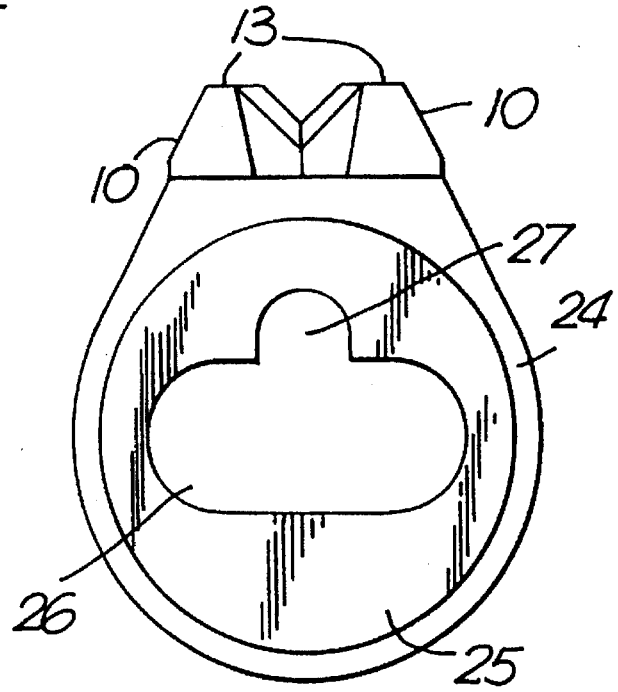
Fig.5B
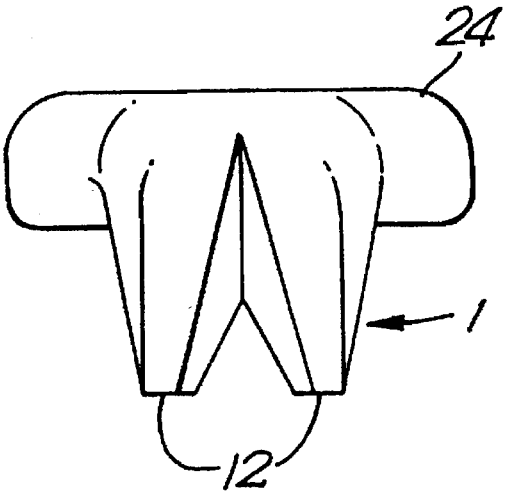
Fig.5C

BREATHING EQUIPMENT

THE PRESENT INVENTION concerns breathing equipment intended to provide a supply of breathable gas to a user. While the invention is applicable to breathing equipment intended for relatively long term use such as by divers or those working in a hazardous atmosphere, the invention is especially applicable to emergency breathing equipment intended to provide a short term supply of breathable gas to a user in a hazardous atmosphere or during temporary submersion. Such emergency breathing equipment may, for instance, be intended for use in escape from smoke-filled enclosures such as aircraft cabins by aircrew and passengers or from military vehicles or vessels; crew escape from submerged enclosures such as ditched aircraft and helicopters; and immediate use by rescue personnel such as fire fighters, ambulance crews and so on in the absence of or while donning conventional long term self-contained breathing equipment.

Especially in the case of emergency breathing equipment and also in the case of self-contained underwater breathing apparatus, it is conventional to provide the supply of breathable gas to a mouthpiece that, typically has a flange with lugs intended to be gripped between the jaws of the user so that the flange lies between the teeth and the lips. Breathable gas may be supplied to the mouthpiece from a suitable demand valve via a flexible hose, or directly from a suitably compact demand valve (such as that disclosed in EP-A-0 449 532) attached to the mouthpiece.

The conventional mouthpiece, of whatever form, has no association with the nose or nasal passages of the user and it is therefore necessary to provide some means of blocking the nasal passages to prevent ingress of ambient atmosphere, or water in the case of underwater use, during breathing by means of the mouthpiece. Traditionally, the nasal passages have been blocked by use of a nose clip.

Nose clips have many practical disadvantages: they are not universally applicable nor are they comfortable in use, being badly tolerated by infants and children in particular. Moreover, by being a separate item of equipment needing to be separately donned, their use can delay full readiness of the equipment in emergency circumstances; and, of course, they can become lost or misplaced while the equipment is not in use. If they are attached to the mouthpiece or some other part of the equipment by a lanyard, to avoid this latter problem, these are obvious inconveniences in use of the equipment.

An object of the present invention is, accordingly, to provide a means for blocking the nasal passages of the user of mouthpiece-equipped breathing apparatus in a manner that is comfortable and reassuring to the user and that results automatically from donning the mouthpiece, while avoiding the problems inherent in the use of separate devices such as the traditional nose clip.

In its broadest aspect the present invention provides a nostril blocker adapted for retained mounting upon the mouthpiece of breathing equipment and comprising a bifurcated resilient element that in use is disposed generally parallel with the mouthpiece gas passage and spaced therefrom by a distance such as to position limbs of the element to straddle the nasal septum and obturate the nostril openings of the user.

In preferred embodiments of the invention, the limbs of the said element have terminations shaped to enter the nostrils of the user and to engage the posterior surfaces thereof so as to lodge securely within the nostril openings and thereby minimise risk of displacement and loss of sealing engagement between the inner lateral and upper surfaces of the limbs with the septum and lower end surfaces of the nose, respectively, of the user. Lodgement of the terminations of the limbs within the nostrils not only provides actual security of location of the device in use: it also feels securely positioned and gives the user confidence in its effectiveness to block the nasal passages despite slight movements of the mouthpiece relative to the face of the user and in consequence of breathing and movements of facial muscles.

The nostril blocker may be formed of any suitable resilient material, a closed cell polyethylene foam material being presently preferred and allowing manufacture by simple compression moulding technology.

Where required to provide the nostril blocker with greater rigidity in, e.g., regions of attachment to the mouthpiece, the resilient element may be stiffened by attachment to or positioning against a stiffening plate of another suitable material such as a rigid polyethylene or PVC.

The invention will be further explained with reference to the accompanying drawings in which.

Figure 4:
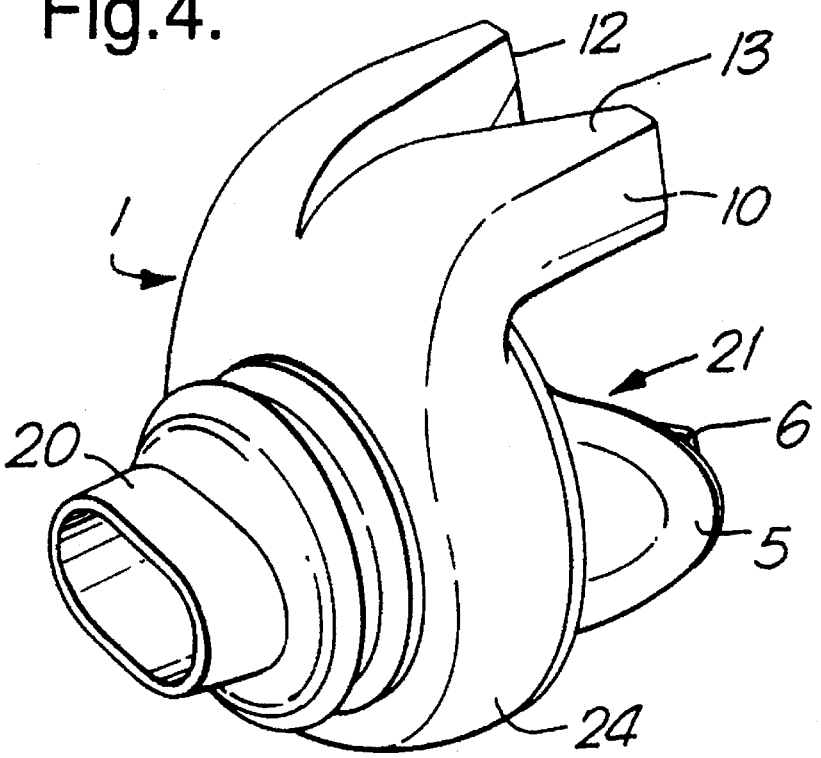
Figure 2:
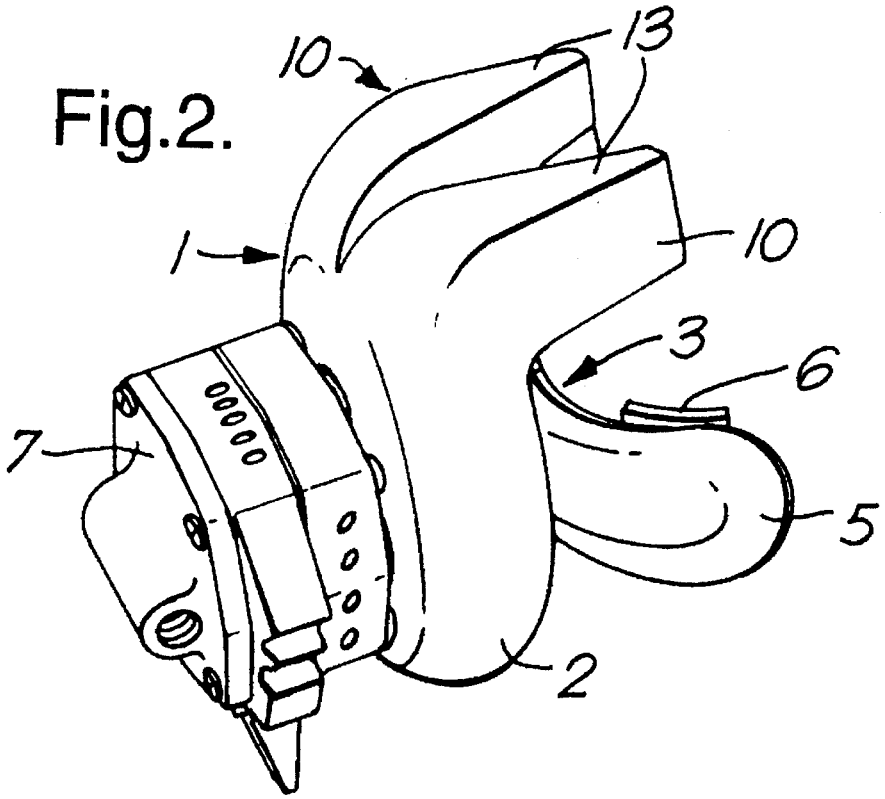
FIG. 2 is a perspective view of the assembly of mouthpiece demand valve and nostril blocker of FIG. 1.
Figure 7:
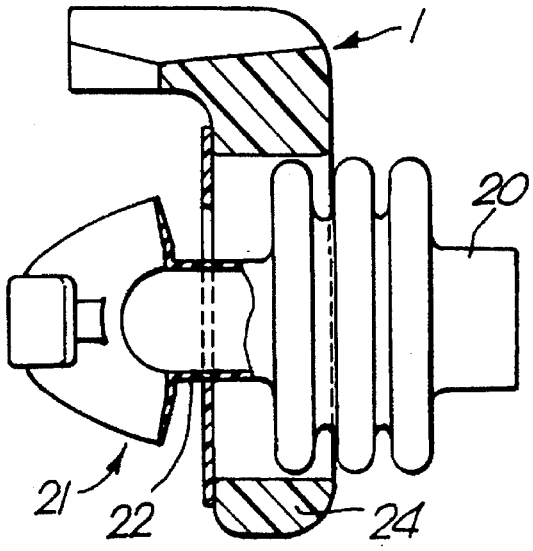
Figure 6:
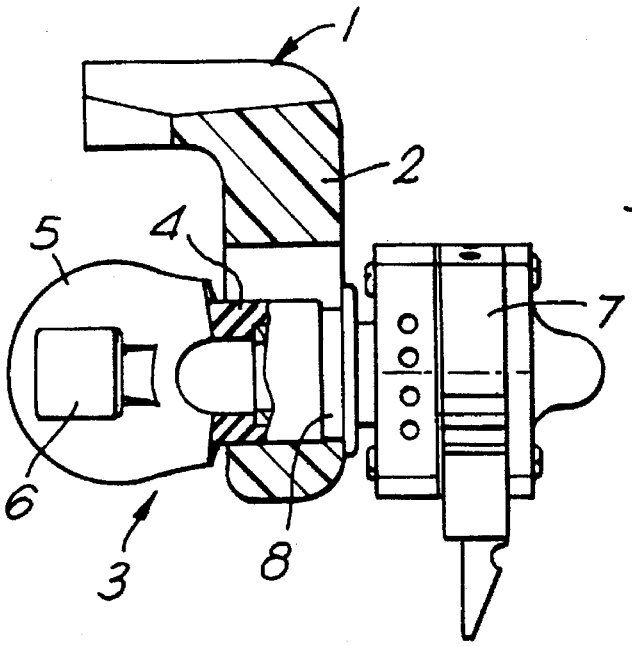

FIGS. 3A, 3B and 3C respectively comprise a front perspective view, a rear view and a plan view of the nostril blocker of the assembly of FIG. 2;

FIG. 4 is a perspective view corresponding with FIG. 2 but showing an assembly of nostril blocker and a mouthpiece that is fed with breathable gas through a flexible hose;

FIGS. 5A, 5B and 5C respectively comprise a front perspective view, a rear view and a plan view of the nostril blocker of the assembly of FIG. 4;

FIG. 6 is a view partly in vertical medial section of the assembly shown in FIG. 2;

FIG. 7 is a corresponding view of the components shown in FIG. 4; and

Figure 8:
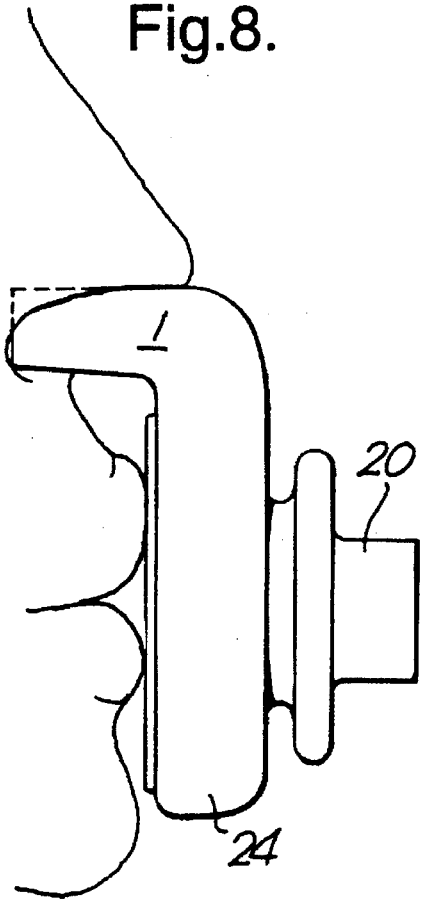

FIG. 8 is a diagrammatic elevation showing use of the embodiment of FIGS. 4, 5A to 5C and 7.

One preferred embodiment of the invention is illustrated in FIGS. 1, 2, 3A to 3C and 6 of the drawings, the nostril blocker of the invention being mounted upon a mouthpiece of emergency breathing equipment of the general configuration disclosed in EP-A-0 449 532 that is characterised by a very compact demand valve capable of being directly mounted on the mouthpiece so as to avoid the use of the conventional large bore corrugated wall flexible gas supply hose of the traditional breathing equipment as hereinafter described in relation to FIGS. 4, 5A, to 5C, 7 and 8.

In the embodiment of FIGS. 1, 2, 3A to 3C and 6, the nostril blocker of the invention comprises a resilient bifurcated element generally shown at 1 that in this case is integrally formed with a mounting collar 2, the whole being conveniently a compression moulding of closed cell polyethylene foam.

The nostril blocker is shown fitted to a mouthpiece of conventional form and generally indicated at 3. This mouthpiece has a central gas passage in the form of a hollow spigot 4 with a terminal arcuate elongate flange 5 having T-section lugs 6 on its inner face to be gripped between the jaws of the user so as to position the flange 5 within the mouth and between the teeth and lips of the user. In this embodiment, the spigot 4 of the mouthpiece fits over and is thereby sealed to the outlet spigot 8 of a demand valve of the construction disclosed in EP-A-0 449 532 and generally indicated at 7.

The collar 2 of the nostril blocker has a central aperture (see FIGS. 3A and 3B) sized to fit reasonably firmly around the inter engaged spigots 4 and 8 of the mouthpiece and demand valve respectively. As best seen in FIG. 3B, the bore of the collar 2, that generally matches the external shape of the spigot 4, has a lobe 9 that provides space for the flange 5 of the mouthpiece to pass through the collar 2 when the flange 5 is deformed by folding generally into alignment with the spigot 4. This provides for attachment and detachment of the nostril blocker without interference with the connection between the mouthpiece 3 and the demand valve 7.

Figure 1:
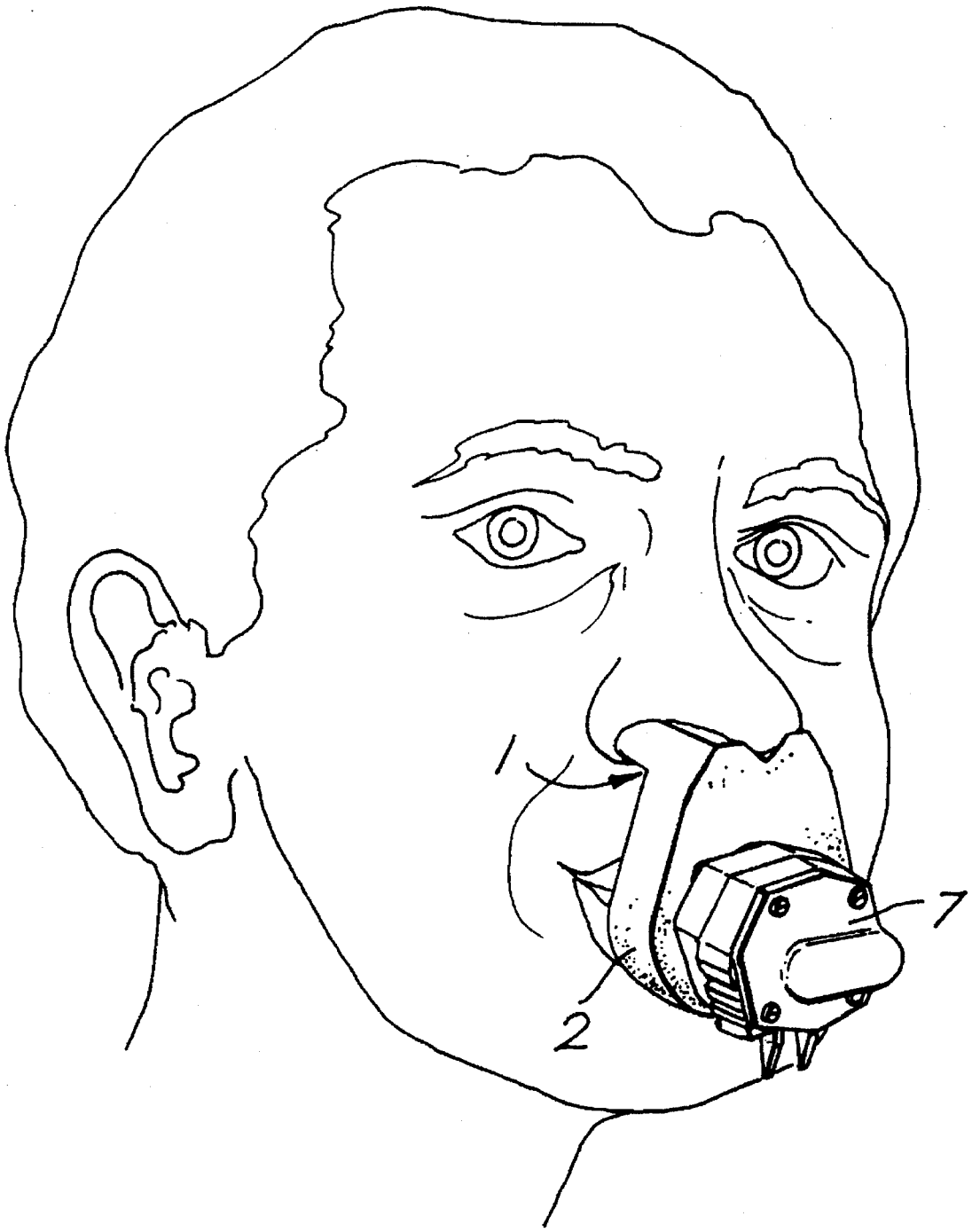
FIG. 1 illustrates a preferred embodiment of the nostril blocker in use in association with a mouthpiece having a directly attached demand valve of the construction disclosed in EP-A-0 449 532.

The bifurcated element 1 of the nostril blocker has limbs 10 that, as shown, define a V-shaped channel therebetween and extend generally parallel with the gas passage of the mouthpiece when the device is in place on the latter, the limbs 10 being spaced from the axis of the gas passage by such an amount as to position the limbs partly to enter the nostrils of the user when the mouthpiece 3 is in its position of use, having its lugs 6 gripped by the user's jaws (see FIG. 1).

The limbs 10 have their adjacent, inner, lateral surfaces shaped as shown in FIGS. 2, 3A to 3C and 6 to engage the nasal septum of the user and to seal thereagainst when the terminations 12 of the limbs 10 have entered the nostrils and lodged in engagement with the posterior surfaces thereof. When so lodged, the upper surfaces 13 of the limbs 10 engage the nose of the user around the nostril end whereby the device effectively blocks the nasal passages in a comfortable manner that engenders a feeling of security giving the user confidence in its effectiveness to prevent ingress of ambient atmosphere or water, as the case may be.

FIGS. 4, 5A, to 5C, 7 and 8 illustrate a further embodiment of the invention adapted to the requirements of the more conventional breathing equipment having a mouthpiece 21 connecting a demand valve or the like (not shown) by means of a large-bore flexible corrugated hose 20. The mouthpiece 21 is generally of the same configuration as the mouthpiece 3 of FIGS. 1, 2, 3A to 3C and 6, differing mainly in having a thin walled spigot 22 shown (FIG. 7) as an integral continuation of the hose 20 but in practice usually formed separately from the latter but permanently secured thereto as by solvent welding.

The nostril blocker of FIGS. 4, 5A, to 5C, 7 and 8 differs from that of FIGS. 1, 2, 3A to 3C and 6 by reason of the need for its attachment collar 24 to accommodate the relatively large diameter of the hose 20. Thus, the collar 24 has a suitably enlarged bore to fit over the hose 20, but to ensure adequate rigidity and proper positioning of the nostril blocker 1 of the device, the collar 24 is secured, as by solvent welding, to a stiffening plate 25 having, like the collar 2 of the device of FIGS. 1, 2, 3A to 3C and 6, a central bore 26 matching the external configuration (usually oval or flattened circular) of the spigot 22 but with a lobe 27 to enable the passage therethrough of the appropriately folded mouthpiece flange, for fitting and removal purposes.

As is apparent, the nostril blocker of the invention overcomes the discussed problems of the conventional use of nose clips. The device is comfortable and confidence-inspiring in use and becomes automatically positioned by the mere act of donning the mouthpiece. There is no possibility of the device becoming misplaced or lost when the breathing equipment is not in use, and little chance of the device becoming displaced and failing to function as required, for so long as the mouthpiece is in place and gripped by the jaws of the user.

The features disclosed in the foregoing description, in the following claims and/or in the accompanying drawings may, both separately and in any combination thereof, be material for realising the invention in diverse forms thereof.

We claim:

1. A nostril blocker for mounting upon a mouthpiece of breathing equipment and comprising a resilient element including a collar having an aperture extending therethrough along a first axis to receive a conduit for supplying a breathing gas to the mouthpiece and further including a bifurcated part extending from said collar parallel with said first axis but spaced therefrom, said bifurcated part defining two limbs extending parallel with said first axis and ending in free terminations such that said two limbs define a V-shaped channel therebetween, wherein, with the nostril blocker fitted on said conduit so that said first axis extends forwardly from a wearer's face, said two limbs can straddle the nasal septum of the wearer, with said free terminations projected into respective nostrils of the wearer in a direction parallel with said first axis to engage posterior surfaces of the nostrils and surfaces of said limbs remote from said first axis can obturate nostril openings of the wearer.

2. A nostril blocker according to claim 1 which is formed of closed cell polyethylene foam.

3. A nostril blocker according to claim 1 which includes an annular stiffening plate secured to one end face of said collar and having an aperture therethrough which is in register with said aperture in the collar.

4. Breathing equipment including a mouthpiece and a gas conduit extending to the mouthpiece for supplying a breathing gas, and a nostril blocker comprising a resilient element including a collar having an aperture extending therethrough through which said gas conduit extends along a first axis and further including a bifurcated part extending from said collar parallel with said first axis but spaced therefrom, said bifurcated part defining two limbs extending parallel with said first axis and ending in free terminations such that said two limbs define a V-shaped channel therebetween, wherein, with the nostril blocker fitted on said conduit so that said first axis extends forwardly from a wearer's face, said two limbs can straddle the nasal septum of the wearer, with said free terminations projected into respective nostrils of the wearer in a direction parallel with said first axis to engage posterior surfaces of the nostrils and surfaces of said limbs remote from said first axis can obturate nostril openings of the wearer.

5. Breathing equipment according to claim 4 wherein said nostril blocker if formed of closed cell polyethylene foam.

6. Breathing equipment according to claim 4 wherein said nostril blocker includes an annular stiffening plate secured to one end face of said collar and having an aperture therethrough which is in register with said aperture in the collar.

7. Breathing equipment according to claim 4 wherein the mouthpiece has a flexible flange and wherein a cross-sectional shape of the aperture in the collar matches an external cross-sectional shape of said conduit except that the aperture in the collar has a lobe which provides space for passage of the flange after folding of the flange, whereby the nostril blocker can be attached to and detached from the mouthpiece by being passed over the mouthpiece, including said flange.

8. Breathing equipment according to claim 4 wherein the mouthpiece has a flexible flange and a first conduit part extending from said flange to a hose which is of substantially greater diameter than said first conduit part, wherein the nostril blocker includes an annular stiffening plate secured to one end face of said collar and having an aperture therethrough which is in register with said aperture in the collar, a cross-sectional shape of the aperture in the collar matching an external cross-sectional shape of said first conduit part except that the aperture in the stiffening plate has a lobe which provides space for passage of the flange after folding the flange, and wherein the aperture through the collar of the nostril blocker matches in diameter that of said hose, and receives a portion of said hose, whereby the nostril blocker can be attached and detached from the mouthpiece by being passed over the mouthpiece, including said flange.

9. Breathing equipment including a mouthpiece and a gas conduit extending to the mouthpiece for supplying a breathing gas, and a nostril blocker comprising a resilient element including a collar having an aperture extending therethrough through which said gas conduit extends along a first axis and further including a bifurcated part extending from said collar parallel with said first axis but spaced therefrom, said bifurcated part defining two limbs extending parallel with said first axis and ending in free terminations such that with the nostril blocker fitted on said conduit so that said first axis extends forwardly from a wearer's face, said two limbs can straddle the nasal septum of the wearer, with said free terminations projected into respective nostrils of the wearer in a direction parallel with said first axis to engage posterior surfaces of the nostrils and surfaces of said limbs remote from said first axis can obturate nostril openings of the wearer, wherein the mouthpiece has a flexible flange and wherein a cross-sectional shape of the aperture in the collar matches an external cross-sectional shape of said conduit except that the aperture in the collar has a lobe which provides space for passage of the flange after folding of the flange, whereby the nostril blocker can be attached to and detached from the mouthpiece by being passed over the mouthpiece, including said flange.

10. Breathing equipment including a mouthpiece and a gas conduit extending to the mouthpiece for supplying a breathing gas, and a nostril blocker comprising a resilient element including a collar having an aperture extending therethrough through which said gas conduit extends along a first axis and further including a bifurcated part extending from said collar parallel with said first axis but spaced therefrom, said bifurcated part defining two limbs extending parallel with said first axis and ending in free terminations such that with the nostril blocker fitted on said conduit so that said first axis extends forwardly from a wearer's face, said two limbs can straddle the nasal septum of the wearer, with said free terminations projected into respective nostrils of the wearer in a direction parallel with said first axis to engage posterior surfaces of the nostrils and surfaces of said limbs remote from said first axis can obturate nostril openings of the wearer, wherein the mouthpiece has a flexible flange and a first conduit part extending from said flange to a hose which is of substantially greater diameter than said first conduit part, wherein the nostril blocker includes an annular stiffening plate secured to one end face of said collar and having an aperture therethrough which is in register with said aperture in the collar, a cross-sectional shape of the aperture in the collar matching an external cross-sectional shape of said first conduit part except that the aperture in the stiffening plate has a lobe which provides space for passage of the flange after folding the flange, and wherein the aperture through the collar of the nostril blocker matches in diameter that of said hose, and receives a portion of said hose, whereby the nostril blocker can be attached and detached from the mouthpiece by being passed over the mouthpiece, including said flange.

* * * * *